US005373287A

United States Patent [19]

Doublet

[11] Patent Number: 5,373,287

[45] Date of Patent: Dec. 13, 1994

[54] ANTI-THEFT DEVICE FOR HOISTING OR STRIKING A FLAG OR THE LIKE

[75] Inventor: Luc Doublet, Seclin, France

[73] Assignee: Etablissements Doublet S.A., Avelin, France

[21] Appl. No.: 977,623

[22] Filed: Nov. 17, 1992

[30] Foreign Application Priority Data

Nov. 26, 1991 [FR] France ..... 9114588

[51] Int. Cl.[5] ..... G08C 19/00

[52] U.S. Cl. ..... 340/825.69; 340/825.72; 116/173

[58] Field of Search ..... 340/825.69, 825.72; 116/173; 40/218, 601

[56] References Cited

U.S. PATENT DOCUMENTS 3,675,615 7/1972 Stangarone et al. .
3,675,616 7/1972 McInnis .
3,737,749 6/1973 Schmidt .
3,923,001 12/1975 Murdock .
4,791,878 12/1988 Lewis ..... 116/173

*Primary Examiner*—Donald J. Yusko
*Assistant Examiner*—Gregg V. Miller
*Attorney, Agent, or Firm*—Roland Plottel

[57] ABSTRACT

Anti-theft device for hoisting or striking a flag or the like (6) along a support structure, in particular a vertical pole (2), with of a halyard (8) interacting with a drive pulley (18) mounted at the upper part of this pole and one end of which links (33) to the upper corner of the flag. In this device the axle (19) of the drive pulley is rotationally controlled, in the direction which rolls up the halyard to hoist the flag or unrolls it to strike the latter, by a reduction motor (21) powered by an electrical energy source (15), controlled via a control circuit from a receiver (25) sensitive to radiation, which is preferably encoded, originating from a transmitter (9) situated remotely.

13 Claims, 1 Drawing Sheet

ANTI-THEFT DEVICE FOR HOISTING OR STRIKING A FLAG OR THE LIKE

BACKGROUND OF THE INVENTION

1. Field of the Invention

The present invention relates to an anti-theft device for automatically hoisting or striking a flag on a carrying structure and in particular, although not exclusively, on a vertical support pole.

2. Description of the Prior Art

The conventional ways of hoisting a flag at the end of a pole are known, and which most generally consist in providing a pulley at the top of the said pole, in the groove of which pulley there passes a halyard equipped at the end with a shackle or other similar means for fastening to an eyelet made in the upper corner of the flag to be hoisted, this halyard which extends along the pole being, if necessary, returned by another pulley mounted at the base of the latter, so as to be connected at its opposite end to the lower corner of the flag. According to the direction of traction exerted on the halyard which is suitably tensioned between its two pulleys, it is thus possible to raise or lower the flag along the pole, the halyard thus forming a continuous loop.

Now, this well-known and notably simple system has the drawback that the halyard is accessible at the outside of the pole at any moment and that the flag hoisted on the latter may be struck, or even removed by a malevolent third party, who has only to move the halyard so as to lower the flag before separating the eyelets for attaching the latter relative to the ends of this halyard.

In order to overcome this drawback, it has already been provided to arrange the halyard, and in particular the two strands of the latter which move in opposite directions in the groove of the pulley provided at the upper part of the pole, inside a groove or a housing made actually inside this pole, the second pulley provided at the base of the pole and the parts of the halyard which roll up on the pulley being accessible via a hatch provided in the surface of the pole, this hatch normally being closed by a pivoting door which can be locked and which can only be opened by a user who has the key to open this hatch.

However, this solution is still not entirely satisfactory, since unauthorised unlocking of the hatch in general does not present any difficulties which cannot be overcome, so that the halyard may be controlled in the direction which strikes the flag and the latter can then be easily stolen or changed in an untimely fashion.

SUMMARY OF THE INVENTION

The present invention relates to a device for automatically hoisting or striking a flag, a pennant, colors etc. relative to a support structure, which device eliminates these drawbacks, by preventing the means which raise or lower the flag from being directly accessible to a user situated on the ground or close to the latter, in particular in the immediate proximity of the base of the pole carrying this flag or more generally of the support structure in question.

The invention also relates to a device which makes it possible for an authorised user to easily change the flag, in particular when replacing this flag by another carrying a different emblem or alternatively following deterioration or degradation of the initially hoisted flag, especially due to the climate, the wind or any other external cause.

For this purpose, the device in question, for hoisting or striking a flag or the like along a support structure, in particular a vertical pole, by means of a halyard interacting with a drive pulley mounted at the upper part of this pole and one end of which comprises a means for linking to the upper corner of the flag, the axle of the drive pulley being rotationally controlled, in the direction which rolls up the halyard to hoist the flag or unrolls it to strike the latter, by means of a reduction motor powered by an electrical energy source, is characterized in that the said source is controlled via a control circuit from a receiver sensitive to radiation, which is preferably encoded, originating from a transmitter situated remotely, the receiver and the reduction motor which control the drive pulley of the halyard being housed in a protection casing arranged at the upper part of the vertical pole, this casing comprising, at its part directed towards the ground, a bottom equipped with an opening which is sufficient to allow the halyard to pass through as it rolls up or unrolls on the pulley.

According to the case, the radiation supplied by the transmitter may be an electromagnetic radiation whose frequency corresponds to that of a radio wave, or alternatively an infrared, ultrasound or other radiation, whose energy is sufficient to ensure a robust and reliable link between the transmitter and the receiver.

Advantageously, the halyard comprises, in the vicinity of the means for linking it to the upper corner of the flag, a stop designed to interact with the control contact of a relay placed in the control circuit between the receiver and the reduction motor, so that rotation of the pulley and consequently movement of the halyard are automatically interrupted when the upper corner of the flag is brought into the immediate proximity of the upper end of the pole under the protection casing.

Preferably, the stop carried by the halyard consists of a block, crimped or otherwise immobilised on the halyard, having a profile which is partly conical so that, following the displacement of the halyard as it rolls up on the drive pulley and the block moving towards the upper part of the pole, the said block pushes back the end of the contact of the relay, thereby opening the control circuit.

According to another characteristic of the device, the flag comprises a rigid reed, engaged in a hem delimited by a seam made between the upper corner of the flag connected to the halyard and the opposite corner, on the side of the flag, so as to stiffen the latter, in particular at the end of travel when the flag is arranged under the protection casing at the upper end of the pole. Advantageously, the rigid reed is extended upwards, beyond the flag, so that its projecting end is fitted into a guide housed in the casing.

Preferably, but not necessarily exclusively, the opposite end of the rigid reed is connected to a ballast member intended to hold the reed vertical in the vicinity of the pole. In a preferred embodiment, the ballast member consists of a collar sliding on the pole with sufficient clearance, this collar being connected to an eyelet provided at the base of the reed in the corresponding corner of the flag.

According to yet another characteristic, the protection casing comprises means for conferring autonomous operation upon the energy source powering the reduction motor. In particular, these means may consist of a set of photovoltaic cells mounted in one of the external faces of the casing, these cells being connected to an accumulation battery suitable for permanently delivering, by day and by night, the power necessary for controlling the reduction motor.

Finally, the transmitter remotely actuating the receiver mounted in the protection casing comprises means for continuously or intermittently controlling the reduction motor, these means in particular consisting of two push-buttons, respectively for rolling up or unrolling the halyard and which, when released by the operator, instantaneously stop the rotation of the drive pulley.

Other characteristics of a device for hoisting or striking a flag using a control assembly manoeuvred remotely, in particular without direct intervention by the operator on the halyard to which the flag is connected, will further emerge from the description which follows of embodiments, given by way of nonlimiting examples, with reference to the appended drawing in which:

DESCRIPTION OF THE PREFERRED EMBODIMENTS

Figure 1:
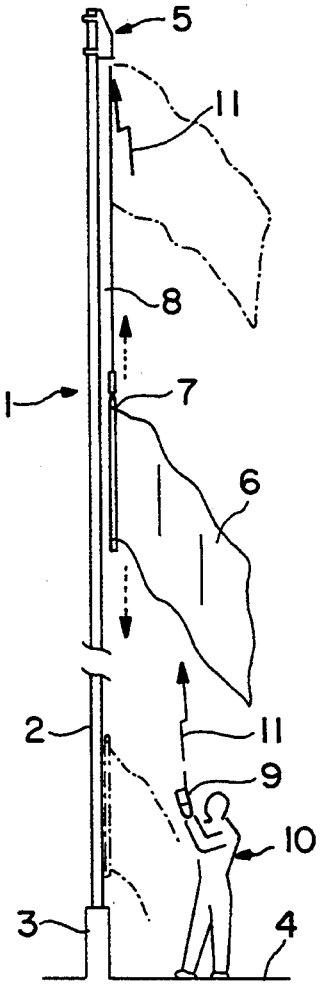
FIG. 1 is a diagrammatic view in elevation of the device in question, enabling the general characteristics of the latter to be illustrated overall.

In FIG. 1, reference i designates the overall device, in particular comprising a vertical pole 2 whose lower end is set into a framework 3 for resting on the ground 4, this pole comprising at its upper end a protection casing 5 for a control mechanism in accordance with the invention and the details of which will be explained later.

In particular, this mechanism is provided so as to allow, according to the case, a flag 6 to be hoisted or struck along a pole 2, one of the upper corners 7 of which flag 6 is connected to a halyard 8 which displaces this flag along the pole, upwards or downwards between two extreme positions, in which the flag is diagrammatically illustrated in the figure in dotted lines.

According to the invention, the mechanism mounted in the casing 5 is designed so as to be remotely controlled from a transmitter casing 9 hand-held by a user 10 on the ground in the vicinity of the base of the pole, and which transmits, in the direction of a receiver 25 (FIG. 2) housed in the casing, an appropriate radiation, represented in the drawing by the zig-zag arrows 11.

Figure 2:
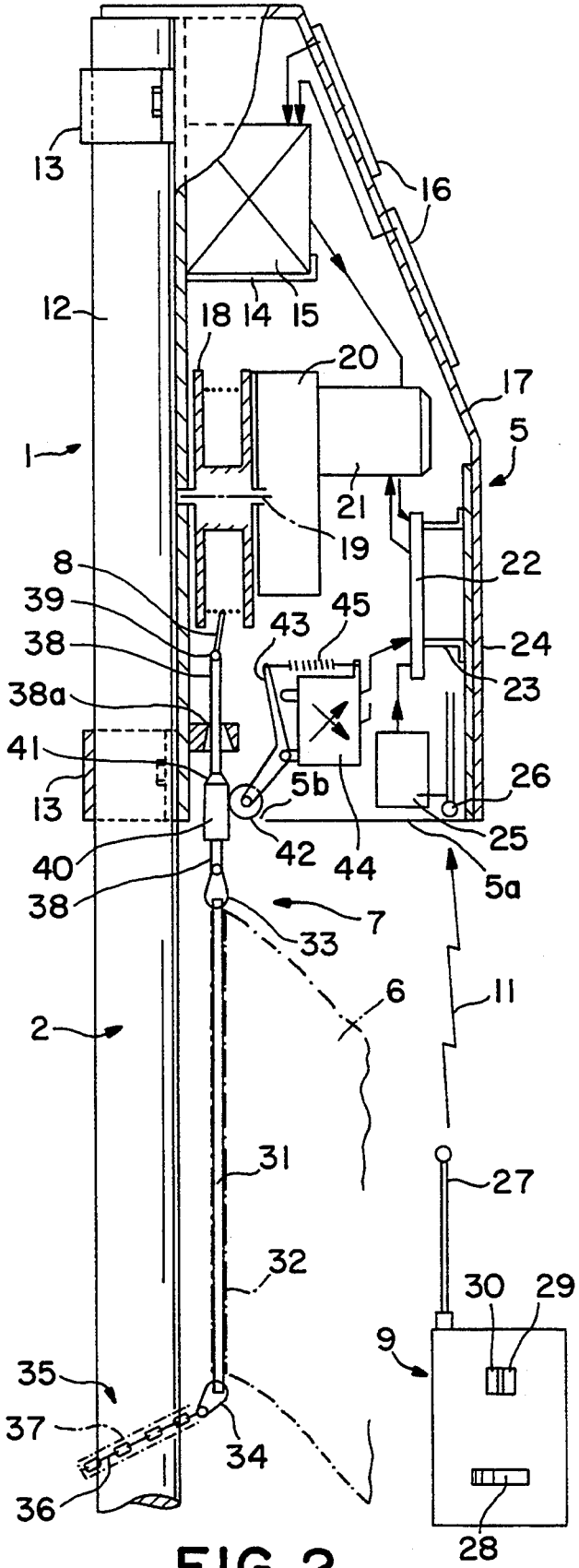
FIG. 2 is a view in transverse section on a larger scale of the upper end of the device, in particular representing the casing for protecting the mechanisms and the control means allowing the flag to be hoisted or struck.

FIG. 2 illustrates, in more detail, a particular embodiment of the device in question and in particular of the set of members mounted-inside the casing 5, the latter being immobilised on the upper end 12 of the pole 2 by clamping collars 13 or the like.

Inside the casing 5, there is thus arranged, on a support platform 14, an accumulation battery 15, advantageously connected to photovoltaic cells 16 mounted in one of the outer faces 17 of the casing, the latter being fixed to the pole 2 with an appropriate orientation relative to the axis of the latter so that the cells 16 are preferentially directed towards the south, in the direction of the sun. These arrangements in particular make it possible to supply the battery 15 with sufficient energy to charge it during the day, and allow operation at any time, the battery discharging as necessary during the night if it is called for.

In the casing 5 there is also mounted a drive pulley 18, in the groove of which the halyard 8 rolls up or unrolls according to the case, making it possible to hoist or strike the flag 6. This pulley comprises a rotation axle 19 in engagement with a reduction gear 20 which is itself driven by the output shaft (not shown) of a motor 21, which is powered from the battery 15. The supply terminals of the motor 21 are arranged in an electric circuit printed on a board 22, immobilised by lugs 23 against one of the sides 24 of the casing 5 inside the latter, this circuit itself being connected to a receiver assembly 25 equipped with an antenna 26 able to pick up the radiation 11 emitted by the transmitter 9. The casing 5 is open at its lower part 5*a* or comprises a bottom 5*a* equipped with at least one opening 5*b* sufficient to allow the passage of the halyard 8 during its movements for raising or lowering the flag 6. In a particularly advantageous fashion, the signal emitted is encoded so as to prevent a non-controlled and in particular unauthorised actuation of the motor 21, this signal coming from the transmitter 9 which is set to the same frequency as the receiver.

The transmitter casing 9 in turn possibly comprises an antenna 27, a stop/start switch 28 for powering or not powering its internal circuits and two push-buttons, respectively 29 and 30, the latter being arranged so that, depending on which is actuated, the signal emitted by the transmitter and received by the receiver 25 controls the motor 21 and consequently the pulley 18 in the direction which rolls up or unrolls the halyard 8, so as to raise or lower the flag 6.

The equipment of the device is supplemented by means of a rigid reed 31 which is housed in a hem 32 of the flag and holds the edge of the latter substantially parallel with the pole 2, regardless of the position of the flag along the latter. In its upper corner, the flag comprises an eyelet 33 so as to allow a link with the halyard 8 and at its lower corner, at the end of the reed 31, a similar eyelet 34, allowing a collar 35, providing appropriate ballast for the reed in its displacement along the pole, to be Joined to the flag. Preferably, this collar is made in the form of a chain 36, mounted in a plastic envelope 37, such an embodiment, however, being only an optional feature but being able to be replaced by any other having an equivalent effect.

Advantageously, the reed 31 comprises a projecting part, directed upwards from the eyelet 33 and in particular consisting of a slim rod 38, preferably directly forming part of the reed and at the end of which there is provided a means 39 for attachment to the end of the halyard, of the type of a shackle, hook, or equivalent system. As a variant, the end of the halyard may be directly connected to the eyelet 33. When the flag is in the raised position, the slim rod 38 engages in particular in a guide 38a mounted inside the casing 5 and in which the halyard 8 slides, so as to immobilise the slim rod and the reed 31 to which it is securely fastened.

On the slim rod 38 there is, moreover, mounted a block 40 forming a stop member, comprising a conical part 41 able to act on a roller 42 mounted at the end of a tipping arm 43 or actuation contact of a relay 44, this arm being returned by a spring 45, so that it permanently closes the circuit of the motor . 21 except when the tipping arm 43 is actuated by the block 40, the resulting opening of the circuit rendering the motor inactive in the direction for rolling up the halyard, the flag therefore being in the maximum raised position.

A control device for raising or striking a flag is thus produced allowing maximum security, the only person being able to manoeuvre the flag being the user who has the control transmitter the upper end of the pole generally being inaccessible directly. Advantageously, the control signal originating from the transmitter is a radio signal, of appropriate frequency, to which the frequency of the receiver is set; as a variant, the radiation coming from the transmitter could be an infrared or ultrasound radiation.

As already underlined, the control signal coming from the transmitter is preferably an encoded signal which the receiver, set to the same frequency, decodes before actuating the motor driving the pulley of the halyard, transmission of the signal only occurring after the user has entered the authorised code into the transmitter and the receiver.

In all cases, the transmitter is provided so that the control buttons which it comprises can manoeuvre the halyard either continuously or by successive pulses, making it possible to stop the displacement of the flag in one direction or the other at any time. The block carried by the halyard in all cases stops the rolling up movement of the latter on its pulley when the flag has reached the top end of its travel. If need be, a similar arrangement could be provided at the lower end of travel, when the flag is completely struck.

The device finally constitutes an entirely self-contained assembly, by virtue of the battery and of the solar cells which it comprises.

Figure 3:
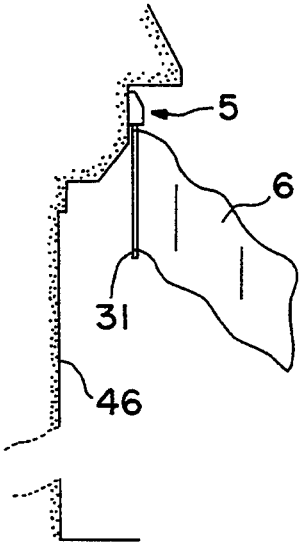
FIG. 3 is a diagrammatic view illustrating another variant.

Of course, it goes without saying that the invention is not limited to the embodiment examples more especially described and represented above; on the contrary it encompasses all variants thereof. In particular, it is evident that the, device can be fitted to any support structure for the flag and not necessarily to a vertical pole. FIG. 3 thus illustrates, diagrammatically, a variant in which the casing 5 is mounted on the wall of a facade of a building 46 or the like, making it possible, in an identical fashion, to hoist or strike a flag 6 by a control which is entirely self-contained and exerted remotely.

The invention claimed is:

1. Anti-theft device for hoisting or striking a flag or the like (6) along a support structure, in particular a vertical pole (2), comprising a halyard (8) interacting with a drive pulley (18) mounted at the upper part of this pole and one end of said halyard comprises a means (33) for linking to the upper corner of the flag, an axle (19) of the drive pulley being rotationally controlled, in the direction which rolls up the halyard to hoist the flag or unrolls it to strike the latter, by means of a reduction motor (21) powered by an electrical energy source (15), said energy source is controlled via a control circuit from a receiver (25) sensitive to radiation, originating from a transmitter (9) situated remotely; the receiver (25), the axle (19), the drive pulley (18), the reduction motor (21) which control the drive pulley (18) of the halyard (8) and the energy source (15), being housed in a protection casing (5) arranged at the upper part of the vertical pole (2); this casing comprising, at its part directed towards the ground, a bottom **(5*a*) equipped with an opening (5*b*) which is sufficient to allow the halyard to pass through as it rolls up or unrolls on the pulley (18)**.

2. Device according to claim 1, characterized in that the transmitter (9) and the receiver (25) are set to the same frequency.

3. Device according to claims 1, characterized in that the radiation supplied by the transmitter (9) is an electromagnetic radiation whose frequency corresponds to that of a radio wave, or alternatively an infrared, ultrasound or other radiation.

4. Device according to claim 1, characterized in that the halyard (8) comprises, in the vicinity of the means (33) for linking it to the upper corner of the flag (6), a stop (40) designed to interact with the control contact (43) of a relay (44) placed in the control circuit between the receiver and the reduction motor, so that rotation of the pulley (18) and consequently movement of the halyard are automatically interrupted when the upper corner of the flag is brought into the immediate proximity of the upper end of the pole (2) under the protection casing (5).

5. Device according to claim 4, characterized in that the stop ( 40 ) carried by the halyard ( 8 ) consists of a block, crimped or otherwise immobilised on the halyard, having a profile (41) which is partly conical so that, following the displacement of the halyard as it rolls up on the drive pulley (18) and the block moving towards the upper part of the pole, the said block pushes back the end (42) of the contact (43) of the relay (44), thereby opening the control circuit.

6. Device according to claim 1, characterized in that the flag (6) comprises a rigid reed (31), engaged in a hem (32) delimited by a seam made between the upper corner of the flag connected to the halyard (8) and the opposite corner, on the side of the flag, so as to suitably stiffen the latter, in particular at the end of travel when the flag is arranged under the protection casing (5) at the upper end of the pole (2).

7. Device according to claim 6, characterized in that the rigid reed (31) is extended upwards, beyond the flag, so that its projecting end (38) is fitted into a guide **(38*a*) housed in the casing (5)**.

8. Device according to claims 6, characterized in that the lower end of the rigid reed (31) is connected to a ballast member (35) intended to hold the reed vertical in the vicinity of the pole (2).

9. Device according to claim 8, characterized in that the ballast member (35) consists of a collar (36) sliding on the pole with sufficient clearance, this collar being connected to an eyelet (34) provided at the base of the reed (31) in the corresponding corner of the flag.

10. Device according to claims 1, characterized in that the protection casing (5) comprises means (16) for conferring autonomous operation upon the energy source (15) powering the reduction motor, in particular consisting of a set of photovoltaic cells (16) mounted in one of the external faces (17) of the casing, these cells being connected to an accumulation battery.

11. Device according to claim 1, characterized in that the transmitter (9) remotely actuating the receiver (25) mounted in the protection casing (5) comprises means (29, 30) for continuously or intermittently controlling the reduction motor (21).

12. The device according to claim 1, wherein the radiation from said transmitter and received by said receiver is encoded.

13. Anti-theft device for hoisting or striking a flag or the like (6) along a support structure, in particular a vertical pole (2), comprising a halyard (8) interacting with a drive pulley (18) mounted at the upper part of this pole and one end of said halyard comprises a means (33) for linking to the upper corner of the flag, an axle (19) of the drive pulley being rotationally controlled, in the direction which rolls up the halyard to hoist the flag or unrolls it to strike the latter, by means of a reduction motor (21) powered by an electrical energy source (15), said energy source is controlled via a control circuit from a receiver (25) sensitive to radiation, originating from a transmitter (9) situated remotely; the receiver (25), the axle (19), the drive pulley (18), the reduction motor (21) which control the drive pulley (18) of the halyard (8) and the energy source (15), being housed in a protection casing (5) arranged at the upper part of the vertical pole (2); this caging comprising, at its part directed towards the ground, 19 a bottom (5*a*) equipped with an opening (5*b*) which is sufficient to allow the halyard to pass through as it rolls up or unrolls on the pulley (18); wherein the halyard (8) comprises, in the vicinity of the means (33) for linking it to the upper corner of the flag (6), a stop (40) designed to interact with the control contact (43) of the relay (44) placed in the control circuit between the receiver and the reduction motor, so that rotation of the pulley (18) and consequently movement of the halyard are automatically interrupted when the upper corner of the flag is brought into the immediate proximity of the upper end of the pole (2) under the protection casing (5), the stop (40) carried by the halyard (8) consists of a block, crimped or otherwise immobilized on the halyard, having a profile (41) which is partly conical so that, following the displacement of the halyard as it rolls up on the drive pulley (18) and the block moving towards the upper part of the pole, the block pushes back the end (42) of the contact (43) of the relay (44), thereby opening the control circuit.

* * * * *